US005370284A

United States Patent [19]

Dirksing

[11] Patent Number: 5,370,284

[45] Date of Patent: Dec. 6, 1994

[54] TOGGLE CLOSURE FOR A RESILIENTLY DEFORMABLE CONTAINER

[75] Inventor: Robert S. Dirksing, Cincinnati, Ohio

[73] Assignee: The Procter & Gamble Company, Cincinnati, Ohio

[21] Appl. No.: 213,294

[22] Filed: Mar. 15, 1994

[51] Int. Cl.[5] ..... B67D 3/00

[52] U.S. Cl. ..... 222/534; 222/536; 222/571

[58] Field of Search ..... 222/108, 148, 534, 536, 222/571

[56] References Cited

U.S. PATENT DOCUMENTS

| | | | |
|---|---|---|---|
| 2,812,120 | 11/1957 | Beall, Jr. | 222/481.5 |
| 2,894,660 | 7/1959 | Gordon | 222/108 |
| 3,377,005 | 4/1968 | Marder | 222/402.13 |
| 3,542,256 | 11/1970 | Waterman | 222/484 |
| 3,734,359 | 5/1973 | Waterman | 222/484 |
| 3,785,528 | 1/1974 | Mandeltort | 222/148 |
| 4,487,342 | 12/1984 | Shy | 222/481.5 |
| 4,645,086 | 2/1987 | Rosenthal | 222/536 |
| 4,678,107 | 7/1987 | Ennis, III | 222/386.5 |
| 4,732,303 | 3/1988 | Wang | 222/484 |
| 4,776,501 | 10/1988 | Ostrowsky | 222/517 |
| 4,838,460 | 6/1989 | Moore et al. | 222/153 |
| 4,962,869 | 10/1990 | Gross et al. | 222/153 |
| 4,978,035 | 12/1990 | Morane et al. | 222/148 X |
| 4,982,882 | 1/1991 | Gueret | 222/531 |
| 5,052,595 | 10/1991 | Mon | 222/571 X |
| 5,147,072 | 9/1992 | Dirksing | 222/212 |

*Primary Examiner*—Kevin P. Shaver

*Attorney, Agent, or Firm*—Kevin C. Johnson; E. Kelly Linman

[57] ABSTRACT

A toggle closure for a resiliently deformable container. The toggle closure includes a cap member, a toggle member, and a vacuum chamber. The vacuum chamber is defined by portions of both the cap member and the toggle member. Upon closing of the toggle member, the vacuum chamber expands and draws fluid from the outlet port substantially preventing the discharge of liquid product from the outlet port.

20 Claims, 4 Drawing Sheets

TOGGLE CLOSURE FOR A RESILIENTLY DEFORMABLE CONTAINER

TECHNICAL FIELD

The present invention relates to a toggle closure for a resiliently deformable container, and more particularly, the present invention relates to a toggle closure for a resiliently deformable container having a vacuum chamber which upon closing of the toggle member draws the fluid product from the outlet port to prevent the fluid product from being ejected upon closing of the toggle member.

BACKGROUND OF THE INVENTION

Toggle closures are commonly used for dispensing creams, lotions, and other thick liquids from resilient containers. Toggle closures offer consumer recognized conveniences over simple threaded closures. For example, toggle closures permit one handed manipulation with a simple one finger push-to-open and push-to-close operation. When used with creams and lotions, the common means to dispense is to squeeze the resilient container. Hence, toggle closures of the type generally know in the art have been suitable for dispensing small quantities of these products upon each operation. However, using such prior art toggle closures to dispense creams, lotions, and other thick liquids from the resilient container often produces an undesirable result. When closing prior art toggle closures the thick cream or lotion product which is within the outlet port is frequently ejected from the product outlet port. After numerous dispensing operations, the ejected creams and lotions cake up on the toggle closure producing a messy result for the user.

It is therefore and object of the present invention to provide an improved toggle closure for a resilient container which substantially reduces the amount of product which is ejected from the product outlet port when the toggle member is closed.

SUMMARY OF THE INVENTION

The present invention pertains, in a preferred embodiment, to a toggle closure for securement in sealed relation to a resiliently deformable container. The resiliently deformable container houses a liquid product. The toggle closure has a closed condition for preventing the loss of the liquid product and an open condition for dispensing the liquid product from the resiliently deformable container. The toggle closure includes a cap member with a means to sealingly engage and secure the cap member to the resiliently deformable container. The cap member includes a platform having an uppermost surface and a lowermost surface. The uppermost surface has a discharge port projecting upward therefrom. The discharge port is defined by a discharge port wall and an inclined ramp. The cap member further includes pivotable bearing means secured on the uppermost surface of the platform. The toggle closure also includes a toggle member having a top wall and a perimeter wall. The top wall has an uppermost and a lowermost surface. The lowermost surface of the top wall includes a pivoting means complementary with the pivotable bearing means of said cap member and an outermost seal wall and an innermost seal wall projecting therefrom. The perimeter wall has an outlet port in fluid communication with the discharge port of the cap member. A vacuum chamber is defined by the lowermost surface of the top wall, the innermost seal wall, and the outermost seal wall of the toggle member, and the discharge port wall, and the inclined ramp of the cap member. The vacuum chamber expands upon closing of the toggle member thereby drawing product into the vacuum chamber from the outlet port.

In a preferred embodiment the cap member includes a top wall and a platform support wall depending from said top wall. Preferably the platform is secured to the platform support wall. The cap member includes an external skirt depending from the top wall of the cap member. The cap member an internal skirt depending from the lowermost surface of the platform.

Preferably, the toggle closure includes a rib member on the external skin complementary with an indentation on the resiliently deformable container. While in the closed condition the toggle member preferably resides totally within the profile of the cap member.

The top wall of the cap member includes a notch, whereby the user can move the toggle member from its closed condition to its open condition without interference from the cap member by pushing downwardly on the uppermost surface of the top wall of said toggle member adjacent said notch. The toggle member can be returned to its closed condition by pushing downwardly on the uppermost surface of said top wall of said toggle member opposite said notch.

While in its closed condition the volume of the vacuum chamber is at a maximum compared to the volume of the vacuum chamber while in its open condition which is at a minimum.

Preferably, the pivoting means on the toggle member is releasably engaged with said pivotal bearing means on said cap member by means of a snap fit.

BRIEF DESCRIPTION OF THE DRAWINGS

While the specification concludes with claims particularly pointing out and distinctly claiming the present invention, it is believed the present invention will be better understood from the following description in conjunction with the accompanying drawings, in which like reference numbers identify identical elements and wherein:

DETAILED DESCRIPTION OF THE INVENTION

Figure 1:
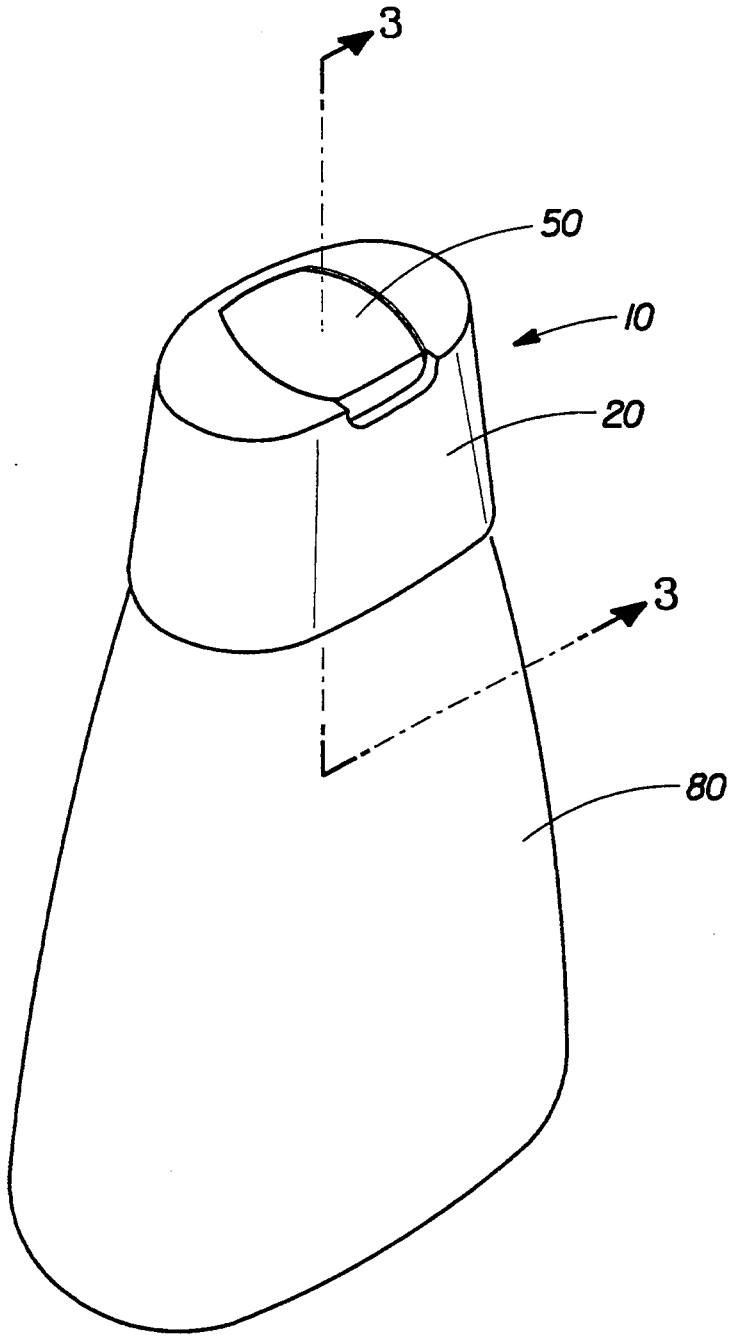
FIG. 1 is a simplified perspective view of a two part toggle closure of the present invention secured to a resiliently deformable container.

In FIG. 1 there is shown a particularly preferred embodiment of a toggle closure 10 of the present invention. Toggle closure 10 comprises a cap member 20 and a toggle member 50. Cap member 20 and toggle member 50 may be integrally molded by means well known in the art from a thermoplastic material, such as polypropylene, polyethylene, or the like. Toggle closure 10 is shown secured to a resiliently deformable container 80. Resilient container 80 may be molded by means well known in the art from a thermoplastic material, such as polyethylene terephthalate(PET), polypropylene, polyethylene, or the like.

Figure 2:
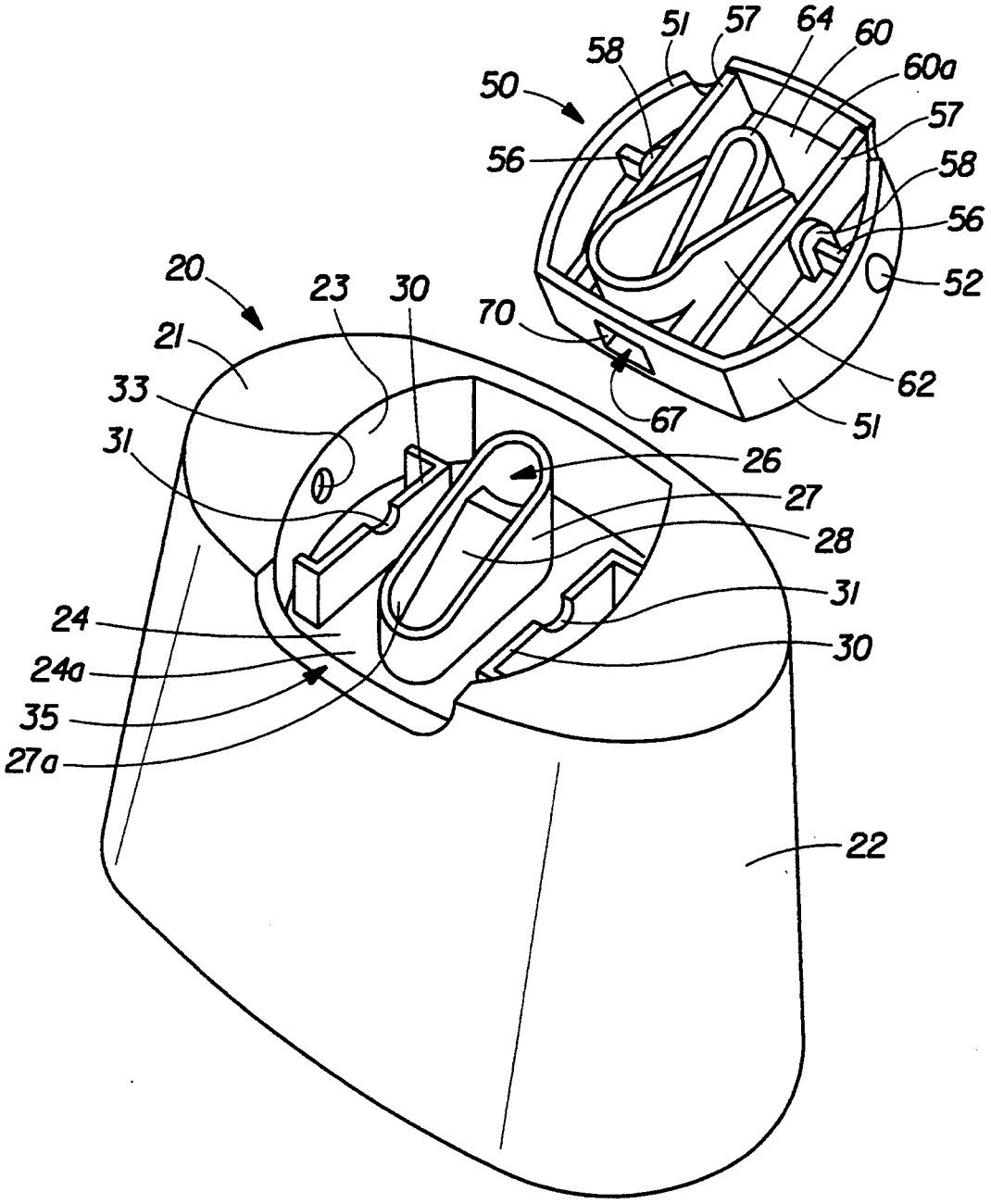
FIG. 2 is an exploded, perspective view of the toggle closure of the present invention with the toggle member rotated to better illustrate the interior portion of the toggle member.

Referring now to FIG. 2 toggle member 50 comprises a top wall 60 having an lowermost surface 60a and an uppermost surface 60b. Toggle member 50 is shown in FIG. 2 as viewed from its lowermost surface 60a. Depending from top wall 60 is perimeter wall 51. Toggle member 50 includes a pair of ribs 57 which support a pair of opposed pivots 58. Ribs 56 help to insure proper spacing from perimeter wall 51 and provide additional support for ribs 57 and pivots 58. A pair of bosses 52 which are concentric with the pivots 58 project outwardly from the perimeter wall 51 of toggle member 50.

Toggle member 50 further comprises an outermost seal wall 62 and an innermost seal wall 64 projecting from the lowermost surface 60a of top wall 60. Although not visible in FIG. 2, there is an opening 68 between innermost and outermost seal walls 62 and 64, respectively, for receiving discharge port wall 27 of cap member 20. A liquid discharge channel 67 provides fluid communication between the opening 68 located between the innermost and outermost seal walls 62, 64 and the product outlet port 70 in perimeter wall 51.

Cap member 20 includes a top wall 21 having external skirt 22 depending therefrom. External skirt 22 is shown more clearly in FIGS. 3A–3D. Platform support wall 23 depends from top wall 21. Secured to platform support wall 23 is platform 24. Platform 24 has an uppermost surface 24a and a lowermost surface 24b. Platform 24 is shown in FIG. 2 as viewed from its uppermost surface 24a. Cap member 20 includes a discharge port 26 defined by discharge port wall 27 which projects upward from uppermost surface 24a of platform 24 and an inclined ramp 28 which slopes upward toward discharge port 26. Inclined ramp 28 is secured to the inner surface 27a of discharge port wall 27.

Cap member 20 further comprises a pair of pivotable beating means, such as cutouts 31 on ribs 30, which engage pivots 58 on toggle member 50 in order to provide an axis of rotation "P" as shown in FIGS. 3A–3D. Axis of rotation "P" permits toggle member 50 to rotate relative to cap member 20. A pair of detents 33 are preferably provided on the platform support wall 23 to engage bosses 52 of toggle member 50 when toggle member 50 is snapped into position on cap member 20. This method of assembly totally secures the toggle member 50 to cap member 20.

Top wall 21 includes a notch 35 located remote from discharge port 26. Notch 35 provides clearance for the finger of the user when the toggle member 50 is manually pivoted to its opened condition.

Figure 3A:
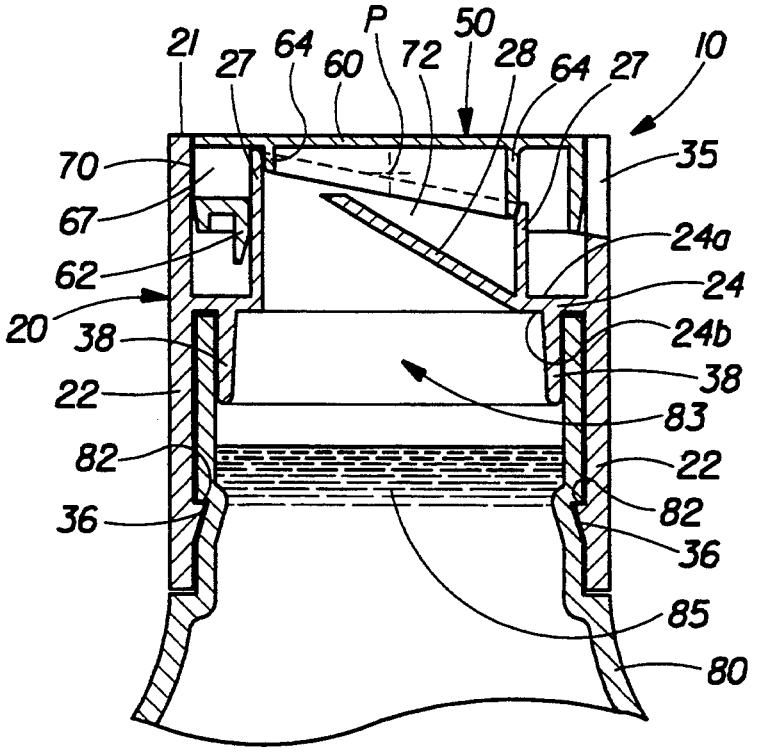
FIGS. 3A–3D are simplified cross-sectional views of the assemble toggle closure of the type generally shown in FIG. 1 with the toggle closure in both the open and closed positions and with the cap member secured to a resiliently deformable container.

External skirt 22 includes internal means, such as rib members 36 shown in FIG. 3A, for releasably securing the cap member 20 to the resiliently deformable container 80. A corresponding indentation 82 on container 80 allows cap member 20 to be snapped onto container 80 adjacent discharge orifice 83. Other suitable closure engaging means, e.g., helical threads, snapfit beads, may be provided to releasably secure the cap member 20 onto the resilient container 80 in a leak tight manner. Alternatively, cap member 20 may, as desired, be nonreleasably secured in leak tight relation to resilient container 80 or the cap member 20 may be integrally formed as part of the container. In the latter situation, an alternate means of introducing the liquid to be housed in the container is preferably provided. An internal skirt 38 depends from lowermost surface 24b of platform 24 to ensure a liquid tight seal between cap member 20 and resilient container 80.

Referring now to FIGS. 3A–3D, which are cross-sectional views of an assembled toggle closure 10 of the type shown in FIG. 1 taken along section line 3—3 of FIG. 1. FIGS. 3A–3D show toggle closure 10 sealingly engaged in leak tight relation to a resilient container 80. A vacuum chamber is created in toggle closure 10 which is formed by portions of the cap member 20 and the toggle member 50. Vacuum chamber 72 is defined by top wall 60, innermost seal wall 64, and outermost seal wall 62 of toggle member 50, and discharge port wall 27 and inclined ramp 28 of cap member 20.

While in the closed condition shown in FIG. 3A, product 85 is prevented from escaping through outlet port 70 as discharge port wall 27 and innermost seal wall 64 are engaged with one another to prevent the discharge of product from container 80 through outlet port 70. In addition, the product outlet port 70 is positioned below top wall 21 of cap member 20 to prevent the discharge of product through outlet port 70 when the toggle closure 10 is in the closed condition. While in the closed condition, toggle member 50 resides totally within the profile of the cap member 20.

Figure 3B:
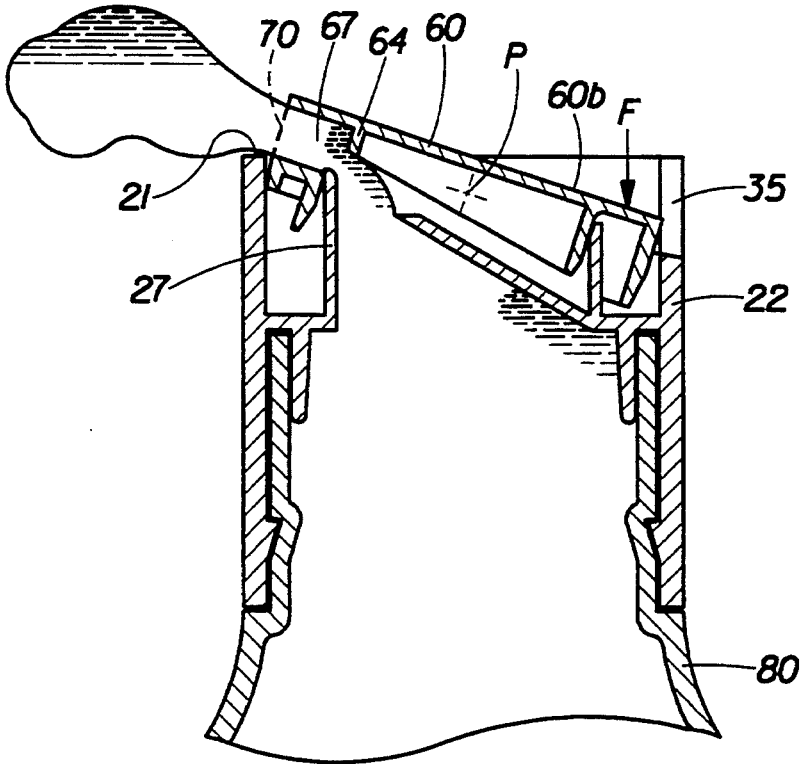

To open toggle closure 10 for dispensing, finger pressure is applied to the uppermost surface 60b of top wall 60 of toggle member 50 in the direction and at about the location indicated by the arrow "F" shown in FIG. 3B. Applied force "F" causes toggle member 50 to rotate about axis of rotation "P". Notch 35 in top wall 21 provides room to enable a human finger to apply force "F" to the top wall 60 of toggle member 50. As toggle member 50 rotates, innermost seal wall 64 disengages discharge port wall 27 creating a fluid passage allowing fluid to flow from the interior of container 80, through liquid discharge channel 67, and out through outlet port 70 of toggle member 50.

Figure 3C:
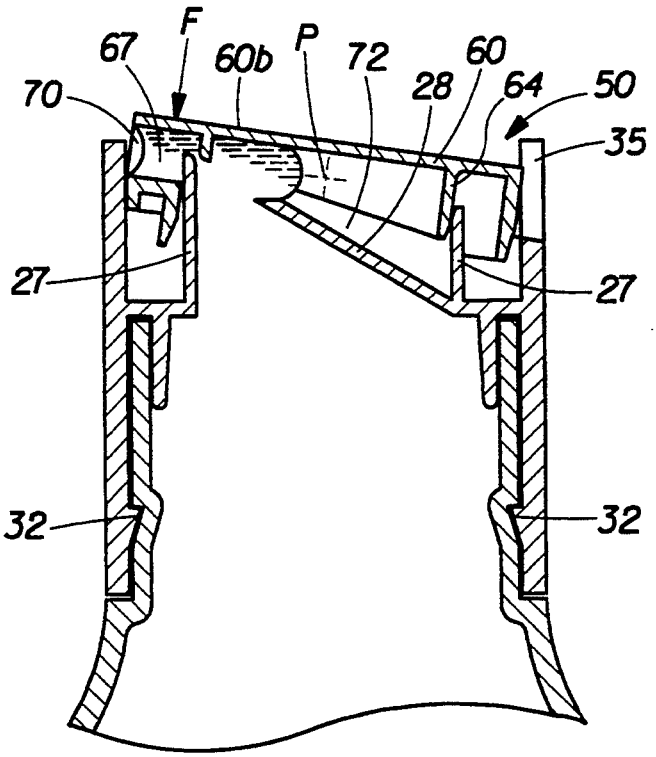

To close toggle closure 50, finger pressure is applied to the uppermost surface 60b of top wall 60 in the direction and at about the location indicated by the arrow "F" shown in FIG. 3C. Applied force "F" causes toggle member 50 to rotate about axis of rotation "P". As toggle member 50 rotates about axis "P", the portion of innermost seal wall 64 near notch 35 remains sealingly engaged with discharge port wall 27. This engagement creates a suckback or vacuum-like action drawing product into vacuum chamber 72 as toggle member 50 is closed. As the volume of vacuum chamber 72 expands during closure it draws fluid away from outlet port 70. thus preventing a spitting or projecting effect which is common among other toggle closure devices. When reaching the fully closed position shown in FIG. 3D, some remnants of product will remain within the vacuum chamber 72.

Figure 3D:
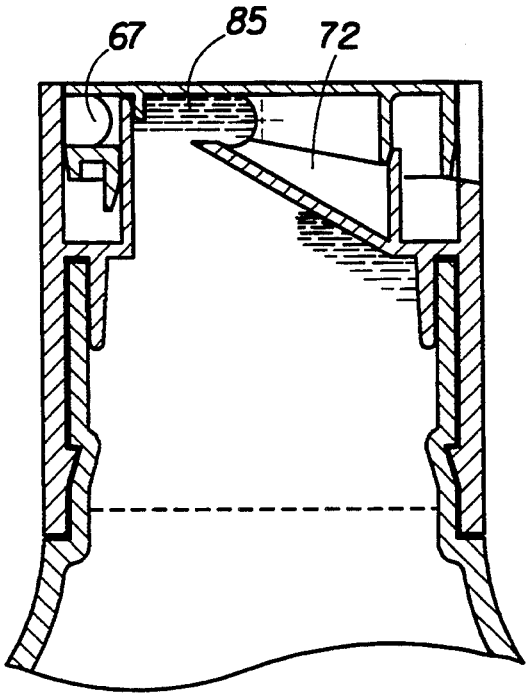

While in the closed condition, as shown in FIG. 3D, the volume of vacuum chamber 72 is at a maximum compared to the volume of vacuum chamber 72 which is at a minimum in its fully opened condition as shown in FIG. 3B. The actual volume of vacuum chamber 72 may change during use of the toggle closure. For example, fluid may come to rest within the vacuum chamber thereby reducing the size of vacuum chamber 72. However, the volume of vacuum chamber 72 will still be at a maximum in the closed condition and at a minimum in the opened condition.

While a particularly preferred embodiment of the present invention has been illustrated and described, it will be evident to those skilled in the art that various changes and modifications can be made without departing from the spirit and scope of the present invention, and it is intended to cover in the appended claims all such modifications that are within the scope of this invention.

What is claimed is:

1. A toggle closure for securement in sealed relation to a resiliently deformable container, said resiliently deformable container housing a liquid product, said toggle closure having a closed condition for preventing the loss of said liquid product and an open condition for dispensing said liquid product from said resiliently deformable container, said toggle closure comprising:

(a) a cap member including means to sealingly engage and secure said cap member to said resiliently deformable container, said cap member including a platform having an uppermost surface and a lowermost surface, said uppermost surface having a discharge port projecting upward therefrom, said discharge port being defined by a discharge port wall and an inclined ramp, said cap member further including pivotable beating means secured on the uppermost surface of said platform;

(b) a toggle member having a top wall and a perimeter wall, said top wall having an uppermost and a lowermost surface, said lowermost surface of said top wall including a pivoting means complementary with said pivotable beating means of said cap member and an outermost seal wall and an innermost seal wall projecting therefrom, said perimeter wall having an outlet port in fluid communication with said discharge port of said cap member; and (c) a vacuum chamber being defined by said cap member and said toggle member, said vacuum chamber communicating with the outlet port in at least the open condition, said vacuum chamber expanding upon closing of said toggle member thereby drawing product into said vacuum chamber from said outlet port.

2. The toggle closure of claim 1, wherein said vacuum chamber has a maximum volume while said toggle closure is in its closed condition.

3. The toggle closure of claim 1, wherein said vacuum chamber is defined by said top wall, said innermost seal wall, and said outermost seal wall of said toggle member, and said discharge port wall and said inclined ramp of said cap member.

4. The toggle closure of claim 3, wherein said cap member further includes a top wall and a platform support wall depending from said top wall.

5. The toggle closure of claim 4 wherein said platform is secured to said platform support wall.

6. The toggle closure of claim 4, wherein said cap member further includes an external skirt depending from said top wall of said cap member.

7. The toggle closure of claim 6, wherein said cap member further includes an internal skirt depending from the lowermost surface of said platform.

8. The toggle closure of claim 6, wherein said means to sealing engage and secure said toggle closure to said resiliently deformable container, includes a rib member on said external skirt complementary with an indentation on said resiliently deformable container.

9. The toggle closure of claim 1, wherein said toggle member resides totally within the profile of said cap member when said toggle member is in its closed condition.

10. The toggle closure of claim 4, wherein said top wall of said cap member further includes a notch, whereby the user can move said toggle member from its closed condition to its open condition without interference from said cap member by pushing downwardly on the uppermost surface of said top wall of said toggle member adjacent said notch.

11. The toggle closure of claim 4, wherein said toggle member can be returned to its closed condition by pushing downwardly on the uppermost surface of said top wall of said toggle member opposite said notch.

12. The toggle closure of claim 4, wherein said pivoting means on said toggle member is releasably engaged with said pivotal bearing means on said cap member by means of a snap fit.

13. A toggle closure for securement in sealed relation to a resiliently deformable container, said resiliently deformable container housing a liquid product, said toggle closure having a closed condition for preventing the loss of said liquid product and an open condition for dispensing said liquid product from said resiliently deformable container, said toggle closure comprising:

(a) a cap member including means to sealingly engage and secure said cap member to said resiliently deformable container, said cap member including a top wall and a platform support wall depending from said top wall, a platform having an uppermost surface and a lowermost surface is secured to said platform support wall, said uppermost surface having a discharge port projecting upward therefrom, said discharge port being defined by a discharge port wall and an inclined ramp, said cap member further including pivotable bearing means secured on the uppermost surface of said platform;

(b) a toggle member having a top wall and a perimeter wall, said top wall having an uppermost and a lowermost surface, said lowermost surface of said top wall including a pivoting means complementary with said pivotable bearing means of said cap member and an outermost seal wall and an innermost seal wall projecting therefrom, said perimeter wall having an outlet port in fluid communication with said discharge port of said cap member; and (c) a vacuum chamber being defined by said lowermost surface of said top wall, said innermost seal wall, and said outermost seal wall of said toggle member, and said discharge port wall and said inclined ramp of said cap member, said vacuum chamber communicating with the outlet port in at least the open condition, said vacuum chamber expanding upon closing of said toggle member thereby drawing product into said vacuum chamber from said outlet port.

14. The toggle closure of claim 13, wherein said cap member further includes an external skirt depending from said top wall of said cap member.

15. The toggle closure of claim 13, wherein said cap member further includes an internal skirt depending from the lowermost surface of said platform.

16. The toggle closure of claim 13, wherein said means to sealingly engage and secure said toggle closure to said resiliently deformable container, includes a rib member on said external skin complimentary with an indentation on said resiliently deformable container.

17. The toggle closure of claim 13, wherein said toggle member resides totally within the profile of said cap member when said toggle member is in its closed condition.

18. The toggle closure of claim 13, wherein said top wall of said cap member further includes a notch, whereby the user can move said toggle member from its closed condition to its open condition without interference from said cap member by pushing downward on the uppermost surface of said top wall of said toggle member adjacent said notch.

19. The toggle closure of claim 13, wherein said toggle member can be returned to its closed condition by pushing downwardly on the uppermost surface of said top wall of said toggle member opposite said notch.

20. The toggle closure of claim 13, wherein said pivoting means on said toggle member is releasably engaged with said pivotal bearing means on said cap member by means of a snap fit.

* * * * *

UNITED STATES PATENT AND TRADEMARK OFFICE

CERTIFICATE OF CORRECTION

PATENT NO. : 5,370,284
DATED : December 6, 1994
INVENTOR(S) : Robert S. Dirksing It is certified that error appears in the above-identified patent and that said Letters Patent is hereby corrected as shown below:

Column 2,
Line 12, -- also includes -- should be inserted between "member" and "an".
Line 15, "skin" should read -- skirt --.

Column 3,
Line 39, "beating" should read -- bearing --.

Column 4,
Line 49, "70." should read -- 70, --.

Column 5,
Line 22, "beating" should read -- bearing --.
Line 28, "beating" should read -- bearing --.

Column 6,
Line 63, "skin" should read -- skirt --.

Signed and Sealed this

Twenty-fifth Day of December, 2001

*Attest:*

*Attesting Officer*

JAMES E. ROGAN
*Director of the United States Patent and Trademark Office*